US008776303B2

(12) United States Patent
Crockett

(10) Patent No.: US 8,776,303 B2
(45) **Date of Patent: *Jul. 15, 2014**

(54) ARTICULATING VACUUM HOSE

(71) Applicant: Federal Signal Corporation, Oak Brook, IL (US)

(72) Inventor: James Crockett, Batavia, IL (US)

(73) Assignee: Federal Signal Corporation, Oak Brook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/951,214

(22) Filed: Jul. 25, 2013

(65) Prior Publication Data

US 2013/0305482 A1 Nov. 21, 2013

Related U.S. Application Data

(63) Continuation of application No. 12/418,220, filed on Apr. 3, 2009, now Pat. No. 8,516,649.

(51) Int. Cl.
*A47L 5/38* (2006.01)

(52) U.S. Cl.
USPC ..... 15/313; 15/340.1

(58) Field of Classification Search
USPC ..... 15/313, 340.1, 339, 302, 352, 353, 315
See application file for complete search history.

(56) References Cited

U.S. PATENT DOCUMENTS

| | | | | |
|---|---|---|---|---|
| 4,659,262 | A | 4/1987 | van Aalst | |
| 5,263,790 | A | 11/1993 | Bickley et al. | |
| 5,419,654 | A | 5/1995 | Kleiger | |
| 6,523,221 | B1 * | 2/2003 | Dahlin et al. | 15/314 |
| 7,255,116 | B2 | 8/2007 | Crocker | |
| 2006/0185689 | A1 | 8/2006 | Crocker | |
| 2007/0169797 | A1 | 7/2007 | Crocker | |
| 2007/0204889 | A1 | 9/2007 | Crocker | |
| 2007/0207711 | A1 | 9/2007 | Crocker | |
| 2008/0066781 | A1 | 3/2008 | Crocker | |

OTHER PUBLICATIONS

"Automated Roadway Debris Vacuum," http://www.ahmct.ucdavis.edu/index.php?title=AutomatedRoadwayDebrisVacuum, pp. 1-4 (May 2007).

"High Production Longitudinal and Manual In-Lane Crack Sealing," http://www.ahmct.ucdavis.edu/index.php?title=LongitudinalandManualIn-LaneCrakSeal . . . , pp. 1-3 (May 2007).

"Strongarm Industrial Manipulators," *Strongarm Industries, Inc.*, 2 pages (Copyright 2009).

(Continued)

*Primary Examiner* — Robert Scruggs
(74) *Attorney, Agent, or Firm* — Merchant & Gould P.C.

(57) ABSTRACT

A debris collection system is disclosed comprising a vehicle and an articulating vacuum hose. The articulating vacuum hose includes a vacuum hose assembly and an articulating arm. The articulating arm is configured to support the vacuum hose assembly which is comprised of a vacuum hose, support bands and support cables. The articulating arm includes a first arm extension and a second arm extension. The first arm extension is mounted to the vehicle and rotatable with respect to the vehicle about two perpendicular pivot axes. The second arm extension is pivotally connected to the first arm extension and is rotatable with respect to the first arm extension about a third pivot axis. The first and second arm extensions can be moved to a folded position wherein both extensions are parallel to each other and to an exterior surface of the vehicle.

14 Claims, 9 Drawing Sheets

(56) References Cited

OTHER PUBLICATIONS

"Jib Cranes—Articulating Arm," http://jibcrames.com/page2.htm, pp. 1-2 (Date Printed Oct. 2, 2009).
"Monoxivent® Product Overview," pp. 1-26 (Dated before Apr. 3, 2009).
"SCL800SM-3X 'One Man Operation' Leaf Collector," *ODB Company*, 3 pages (Dated before Apr. 3, 2009).
"Roadpatcher," *Schwarze Industries*, 2 pages (Feb. 17, 2005).
"Schwarze™ DXR dustless regenerative sweeper," *Schwarze Industries*, 4 pages. (Dated before Apr. 3, 2009).
"Potain MD 310 C Data Sheets," *Manitowoc*, pp. 1-8 (Copyright 2009).
"Spray Patchers RA-300 Spray Patcher," *VT LeeBoy, Inc.*, 2 pages (Dated before Apr. 3, 2009).
"AC5-32 Articulating Crane," *Auto Crane*, 3 pages (Dated before Apr. 3, 2009).

* cited by examiner

ARTICULATING VACUUM HOSE

CROSS REFERENCE TO RELATED APPLICATION

This application is a continuation of application Ser. No. 12/418,220, filed Apr. 3, 2009, which application is incorporated herein by reference in its entirety.

TECHNICAL FIELD

This disclosure relates generally to articulating arms and methods for their use in conjunction with municipal debris collection equipment and vehicles, such as mobile street sweepers.

BACKGROUND

Debris collection vehicles, such as mobile street sweepers, are frequently used in municipal applications to remove debris from hard surfaces, such as streets, parking lots and airport runways. Many such collection vehicles are configured with a primary collection system located beneath the chassis of the vehicle. In such cases, rotating brooms sweep debris beneath the vehicle to a location where the debris is transferred to a debris hopper by a vacuum source. Generally, the vacuum source is a blower that is located within the debris hopper itself and causes the entire hopper interior to be maintained in a negative pressure state. Although this type of collection system is useful for removing debris from large flat areas, there are many areas in which debris cannot be easily or safely removed by the primary collection system of a debris collection vehicle. Examples of such areas are sidewalks, catch basins, manholes, gutters and around posts and various other structures. To reach these areas, secondary collection systems have been developed which generally consist of a vacuum hose that is connected to the vehicle debris hopper. In some applications, the vacuum hose is supported by an arm assembly that is mounted to the vehicle thereby allowing the operator to maneuver the hose without having to bear the full weight of the hose assembly. The support assembly can also be configured to aid in storing the vacuum hose when it is not needed. Although these support assemblies have these advantages, improvements are desired.

SUMMARY

A collection system for removing debris from a surface is disclosed. The collection system comprises a vehicle that has a vacuum source and an articulating vacuum hose. The articulating vacuum hose includes an articulating arm and a vacuum hose.

In one embodiment, the articulating arm comprises a mounting bracket secured to the vehicle, a first arm extension and a second arm extension. The first and second arm extensions each have a first end, a second end and a first side. The first arm extension has a first pivoting mechanism connected to its first end and to the mounting bracket thereby allowing first arm extension to rotate about a first pivot axis. The second arm extension has a second pivoting mechanism that is connected to its first end and to the second end of the first arm extension. A third pivot mechanism is also disclosed that allows first and second arm extensions to rotate together about a third pivot axis. The articulating arm can be configured such that the first and third pivot axes are parallel to and offset from each other such that the first arm extensions can be moved to a folded position wherein the arm extensions are generally parallel and the first sides of the arm extensions face each other. By use of the term "parallel" it is meant to include angles between the arm extensions at least plus or minus two degrees from parallel.

The vacuum hose assembly includes a vacuum hose having a first end and a second end, the first end being connected to the vacuum source, the second end being open for the removal of debris. The vacuum hose is supported by the first and second arm extensions via support bands and cables. The articulating vacuum hose is also movable from a collection position to a storage position. In the collection position, the articulating arm is movable from an extended position to a non-extended position.

A method for collecting debris is also disclosed. In such a method the articulating vacuum hose is mounted to a vehicle and moved from a storage position to a debris collection location. More specifically, an open end of the vacuum hose is moved to the debris collection location. Subsequently, the vacuum source is activated and the debris is collected. The articulating vacuum hose is then returned to the storage position. The method may also include collecting debris that is located at a distance away from the vehicle that is greater than the width of the debris hopper.

DETAILED DESCRIPTION

Figure 1:
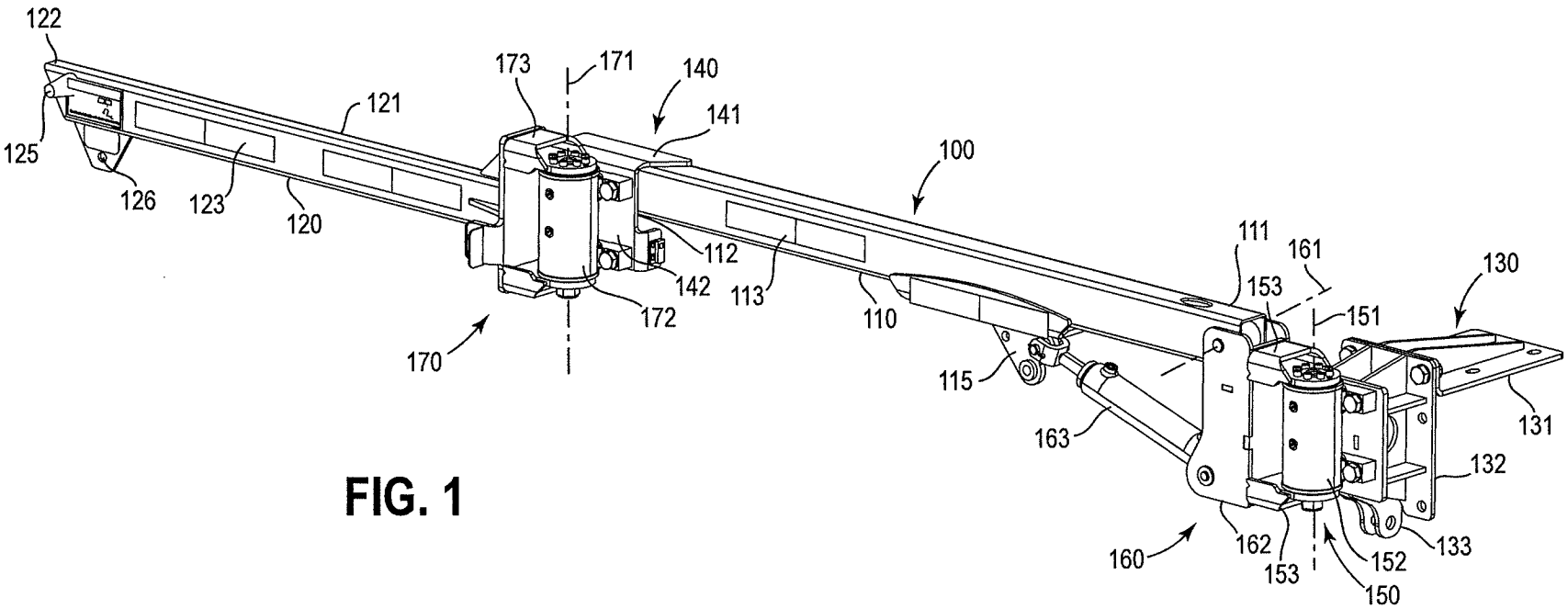
FIG. 1 is a perspective view of one embodiment of an articulating arm in an extended position.
Figure 2:
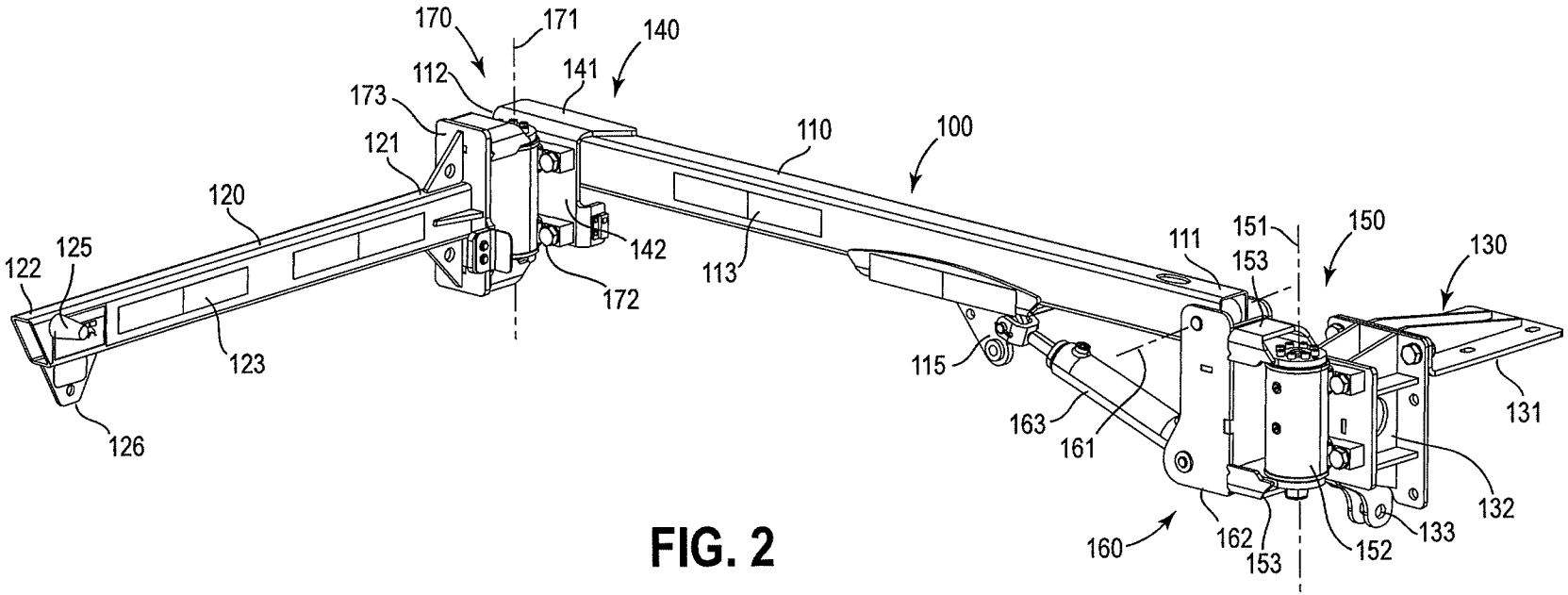
FIG. 2 is a perspective view of the articulating arm of FIG. 1.
Figure 3:
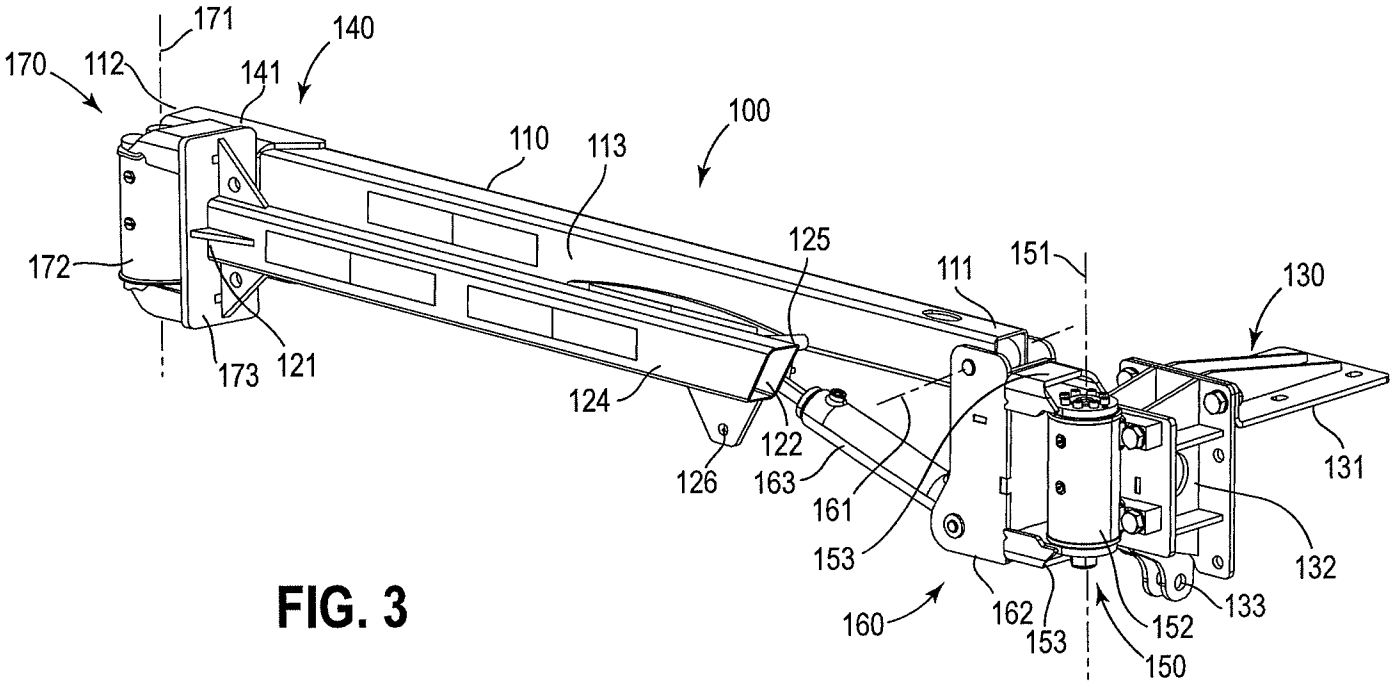
FIG. 3 is a perspective view of the articulating arm of FIG. 1 in a folded position.
Figure 4:
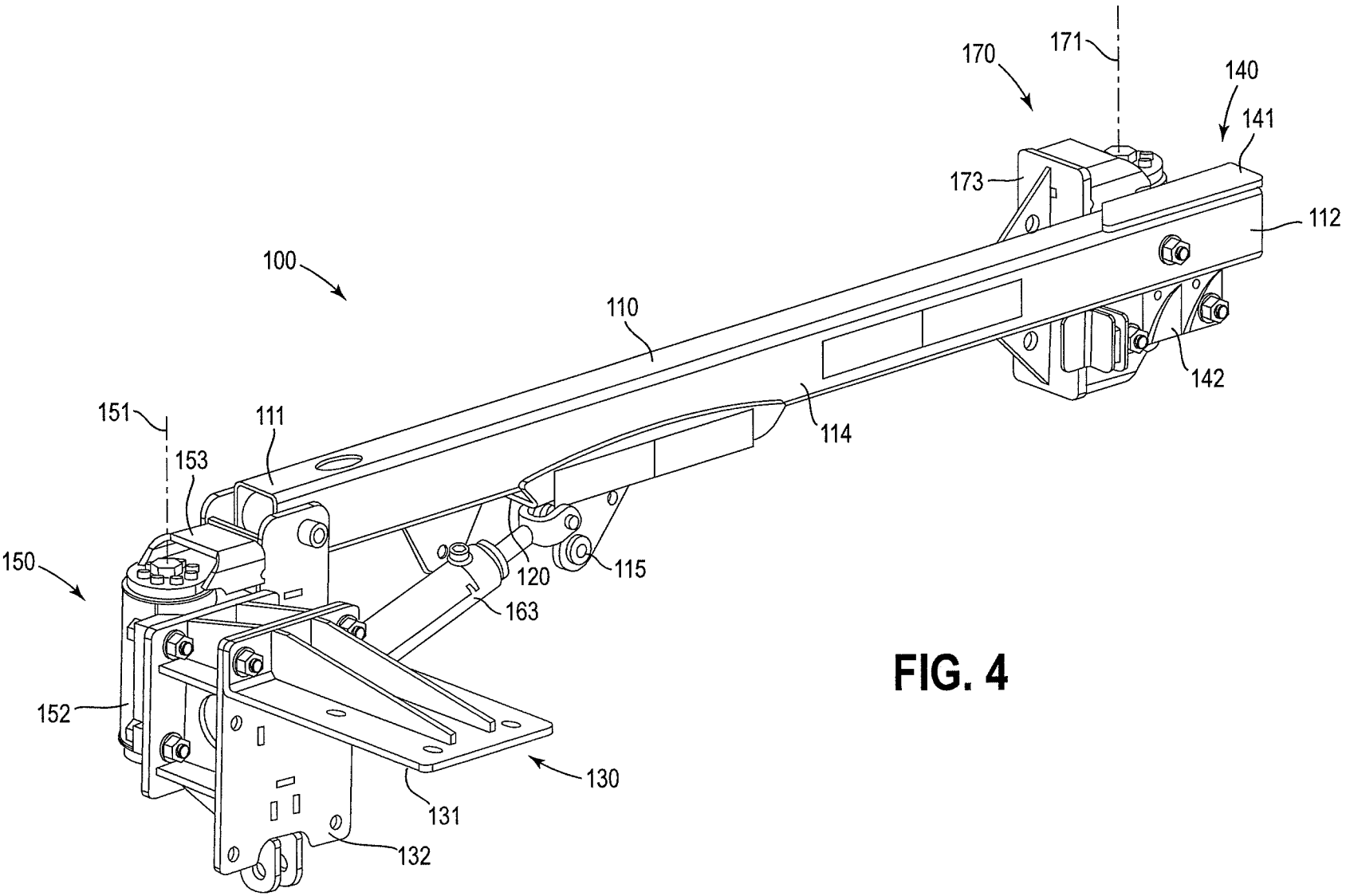
FIG. 4 is a perspective view of the articulating arm of FIG. 1 in a folded position viewed from the opposite side shown in FIG. 3.

Reference will now be made in detail to exemplary aspects of the present invention that are illustrated in the accompanying drawings. Wherever possible, the same reference numbers will be used throughout the drawings to refer to the same or like parts.

In the embodiment illustrated in FIGS. 1-9, articulating arm 100 is shown. Articulating arm 100 is for supporting a tubular segment. In some applications, the tubular segment can be for vacuuming and/or blowing. In the particular embodiment shown, articulating arm 100 supports vacuum hose assembly 300 to form articulating vacuum hose 50. As discussed in the following paragraphs, articulating arm 100 may be constructed and configured in many possible variations for accomplishing this and other purposes without departing from the concepts presented herein. Vacuum hose assembly 300 and articulating vacuum hose 50 are discussed later.

Articulating arm 100 includes a first arm extension 110 and a second arm extension 120. As shown, first arm extension 110 has a first end 111, a second end 112, a first side 113 and a second side 114 while second arm extension 120 has a first end 121, a second end 122, a first side 123 and a second side 124. When articulating arm 100 is used for supporting a tubular element, such as a vacuum hose, first and second arm extensions 110, 120 are fitted with hose support members 115 and 126 respectively.

Articulating arm 100 is shown as including mounting bracket 130. Mounting bracket 130 is for mounting articulating arm 100 to a mounting surface such that first pivot axis 151, discussed in the following paragraph, is located appropriately and has an orientation that is fixed relative to the mounting surface. One example of a mounting surface is a debris hopper that is mounted on a debris collection vehicle. In the exemplary embodiment shown, first mounting bracket 130 has a top portion 131 and a side portion 132. Top and side portions 131, 132 are configured to interface with a mounting location that has corresponding top and side portions which may be mechanically fastened to each other by using any of a variety of methods known in the art, such as by using bolts or welding. Although one skilled in the art will appreciate that mounting bracket 130 may take many forms without departing from the disclosed concepts, it should be noted that mounting bracket 130 must be structured sufficiently to withstand the significant torque and sheer forces that a loaded articulating arm 100 will place upon mounting bracket 130.

Articulating arm 100 is also shown as including first pivot mechanism 150. First pivot mechanism 150 is for rotating first arm extension 110 with respect to mounting bracket 130 about a first pivot axis 151. There are many embodiments of pivot mechanisms possible and suitable for this purpose. In the particular embodiment shown, first pivot mechanism 150 is a hydraulically operated rotary actuator. One skilled in the art will appreciate that other types of actuators, such as electric and/or linear actuators, are also useful for this purpose. As shown, first pivot mechanism 150 includes a first portion 152 and a rotatably connected second portion 153. Pivot mechanism 150 is constructed such that first portion 152 and second portion 153 will selectively rotate with respect to each other, based on a hydraulic pressure input, about first pivot axis 151. As shown, first portion 152 of pivot mechanism 150 is rigidly attached to mounting bracket 130. Second portion 152 is rigidly attached to pivot bracket 162. Pivot bracket 162 is discussed in the following paragraph.

Articulating arm 100 is also shown as including second pivot mechanism 160. Second pivot mechanism 160 is for rotating first arm extension 110 with respect to vehicle 100 about a second pivot axis 161. There are many embodiments of pivot mechanisms possible and suitable for this purpose. As shown, second pivot mechanism 160 includes a pivot bracket 162 and a pivot actuator 163. As previously stated, pivot bracket 162 is rigidly attached to the second portion 152 of first pivot mechanism 150. Pivot bracket 162 is also pivotally connected to first end 111 of first arm extension 110. As shown, first arm extension 110 is rotatable with respect to pivot bracket 160 about a second pivot axis 161 which is perpendicular to first pivot axis 151. Pivot actuator 163 is also pivotally attached to both pivot bracket 162 and first arm extension 110. Pivot actuator 163 is for supporting the weight of articulating arm 100 and any supported elements, such as hose assembly 300. In the embodiment shown, pivot actuator 163 is a hydraulically operated linear actuator which extends and compresses to rotate first arm extension 110 about second pivot axis 161. One skilled in the art will appreciate that other types of actuators, such as electric and/or rotary actuators, are also useful for this purpose. Additionally, it should be appreciated that the orientation of second pivot axis 161 does not change with respect to first arm extension 110. However, the orientation of second pivot axis 161 does change with respect to mounting bracket 130 and vehicle 200 by virtue of the ability of articulating arm 100 to rotate about first pivot axis 151.

Articulating arm 100 is also shown as including third pivot mechanism 170. Third pivot mechanism 170 is for rotating second arm extension 120 with respect to first arm extension 110 about a third pivot axis 171. There are many embodiments of pivot mechanisms possible and suitable for this purpose. In the particular embodiment shown, third pivot mechanism 170 is a hydraulically operated rotary actuator. One skilled in the art will appreciate that other types of actuators, such as electric and/or linear actuators, are also useful for this purpose. As shown, third pivot mechanism 170 includes a first portion 172 and a rotatably connected second portion 173. Pivot mechanism 170 is constructed such that first portion 172 and second portion 173 will selectively rotate with respect to each other, based on a hydraulic pressure input, about third pivot axis 171. As shown, first portion 172 of pivot mechanism 170 is rigidly attached to second mounting plate 140 while second portion 173 is rigidly attached to the first end 121 of second arm extension. Mounting plate 140 has top portion 141 and side portion 142 which are rigidly mounted to the second end 112 of first arm extension 110. As shown, mounting plate 140 and third pivot mechanism 170 are configured so that third pivot axis 171 is adjacent to the first side 113 of first arm extension 110. As a result, third pivot axis 171 is offset from first pivot axis 151. It should be appreciated that the orientation of third pivot axis 171 does not change with respect to first and second arm extensions 110, 120. However, the orientation of third pivot axis 171 does change with respect to pivot bracket 160, mounting bracket 130 and vehicle 200 due to the circumstance that articulating arm 100 can rotate about first pivot axis 151 and second pivot axis 161. It should also be appreciated that first and second arm extension 110, 120 could be configured as four bar linkages such that third pivot axis 171 would be parallel to first pivot axis 151 throughout the entire range of movement of articulating arm 100. As shown, third pivot axis 171 is only parallel to first pivot axis 151 when first arm extension 110 is perpendicular to first pivot axis 151. When mounted on vehicle 200, this would place first arm extension 110 in a generally horizontal position as first pivot axis 151 would be generally perpendicular to the ground.

The range of movement of articulating arm 100 will now be described. Articulating arm can move with three degrees of freedom due to the presence of first pivot axis 151, second pivot axis 161 and third pivot axis 171. As illustrated, second arm extension 120 is rotatable with respect to first arm extension 110 about third pivot axis 171. Second arm extension 120 can rotate about third pivot axis 171 between an extended position and a folded position. In the extended position, the second end 122 of second arm extension 120 is fully extended away from the first end 111 of first arm extension 110 such that first and second arm extensions 110, 120 are essentially end to end. Articulating arm 100 is shown in the extended position in FIGS. 1 and 7. In the folded position, second arm extension 120 is folded flat against first arm extension 110 such that a portion of the first side 123 of second arm extension 120 faces a portion of the first side of 113 of first arm extension and such that swing stop 125 of second arm extension 120 is in contact with first arm extension 110. Articulating arm 100 is shown in the folded position in FIGS. 1 and 4-6. The folded position for articulating arm 100 is possible because third pivot axis 171 is adjacent to the first side 113 of first arm extension 110 instead of being in line with first arm extension 110. However, it should be understood that third pivot mechanism 170 could be relocated to be in line with first arm extension 110 and reconfigured as a double or triple hinged actuated component. Such a configuration would allow for second arm extension 120 to be rotated to the folded position and also allow the second side 124 of second arm extension 120 to be folded flat against the second side 114 of first arm extension 110. As illustrated, second arm extension 120 can rotate through a range of about 180 degrees. Regardless of the position of second arm extension 120, first arm extension 110 can rotate about first pivot axis 151 through about 180 degrees with respect to mounting bracket 130. First arm extension 110 can also rotate about second pivot axis 161 to the degree permitted by pivot actuator 163.

Figure 5:
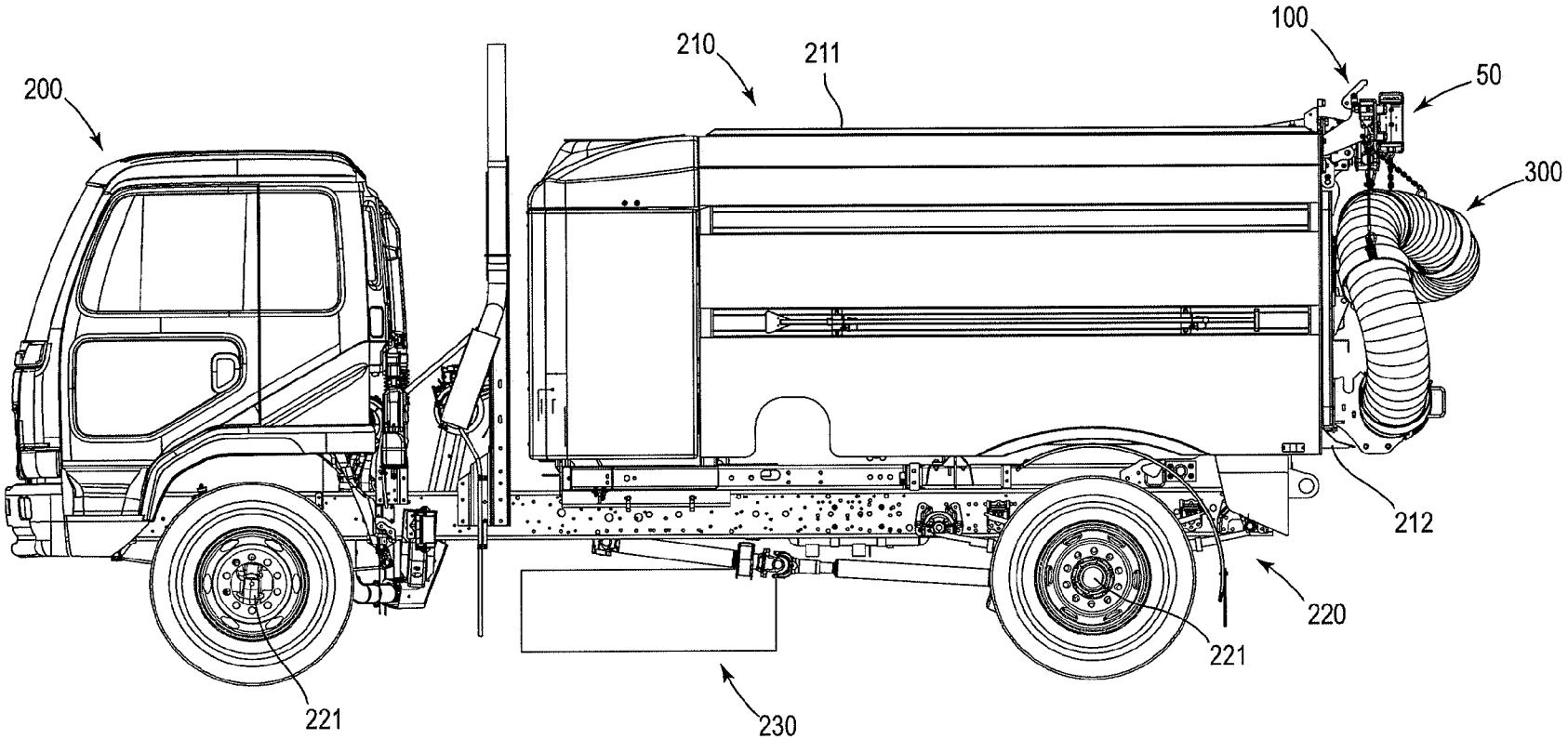
FIG. 5 is a side view of the articulating arm of FIG. 1 mounted to a vehicle debris hopper.

As already indicated, articulating arm 100 can be mounted to a vehicle. FIG. 5 shows a vehicle 200 having a debris hopper 210, a base 220 and a primary collection system 230 (shown schematically) that is located between axles 221. In the exemplary embodiment shown, articulating arm 100 is mounted to debris hopper 210 of vehicle 200 via mounting bracket 130. As configured, the top portion 131 of mounting bracket 130 is attached to a top surface 211 of debris hopper 210 while side portion 132 of mounting bracket 130 is attached to a rear surface 212 of debris hopper 210. One skilled in the art that there are many suitable locations for mounting articulating arm 100, including either side of debris hopper 210 and even the front of the vehicle where articulating arm 100 can be used in a gutter follower application. Additionally, methods for mounting articulating arm 100 to a vehicle 200 without departing from the concepts presented in this disclosure. However, it should be noted that disclosed mounting bracket 130 enables for the mounting of articulating arm 100 without substantially increasing the total height of the vehicle. This is not the case in applications where an articulating arm is post mounted onto the top of the vehicle. As shown, articulating arm 100 is mounted at a location such that articulating arm 100 can be folded to be completely within the rear profile of debris hopper 210, as defined by its width "w", as can be seen on FIG. 6. Articulating arm 100 can also be moved to an extended position wherein the extended length of articulating arm 100 is much greater than width "w", as shown in FIG. 7.

As related previously, articulating arm 100 is for supporting a tubular segment, such as a vacuum hose. In the particular example shown, articulating arm 100 is combined with vacuum hose assembly 300 to form articulating vacuum hose 50. In the embodiment shown at FIGS. 5-9, articulating vacuum hose 50 is used to clean debris from areas that vehicle 200 is unable to reach with the primary collection system 230, or where it is undesirable to do so. As shown, vacuum hose assembly 300 comprises a vacuum hose 310 that has a first end 311 and an open end 312. Vacuum hose assembly also includes support bands 313 and support cables 314 which are used to secure vacuum hose 310 to articulating arm 100. Additionally, the first end 311 of vacuum hose 310 is connected directly to an opening in debris hopper 210 on vehicle 200. In the Figures, the opening is obscured by first end 311 of vacuum hose 310. A vacuum source within debris hopper 210 (not shown) causes the interior of debris hopper 210 to be in a substantially negative pressure condition and provides a vacuum force at the open end 312 of vacuum hose 310 sufficient for debris collection.

Figure 9:
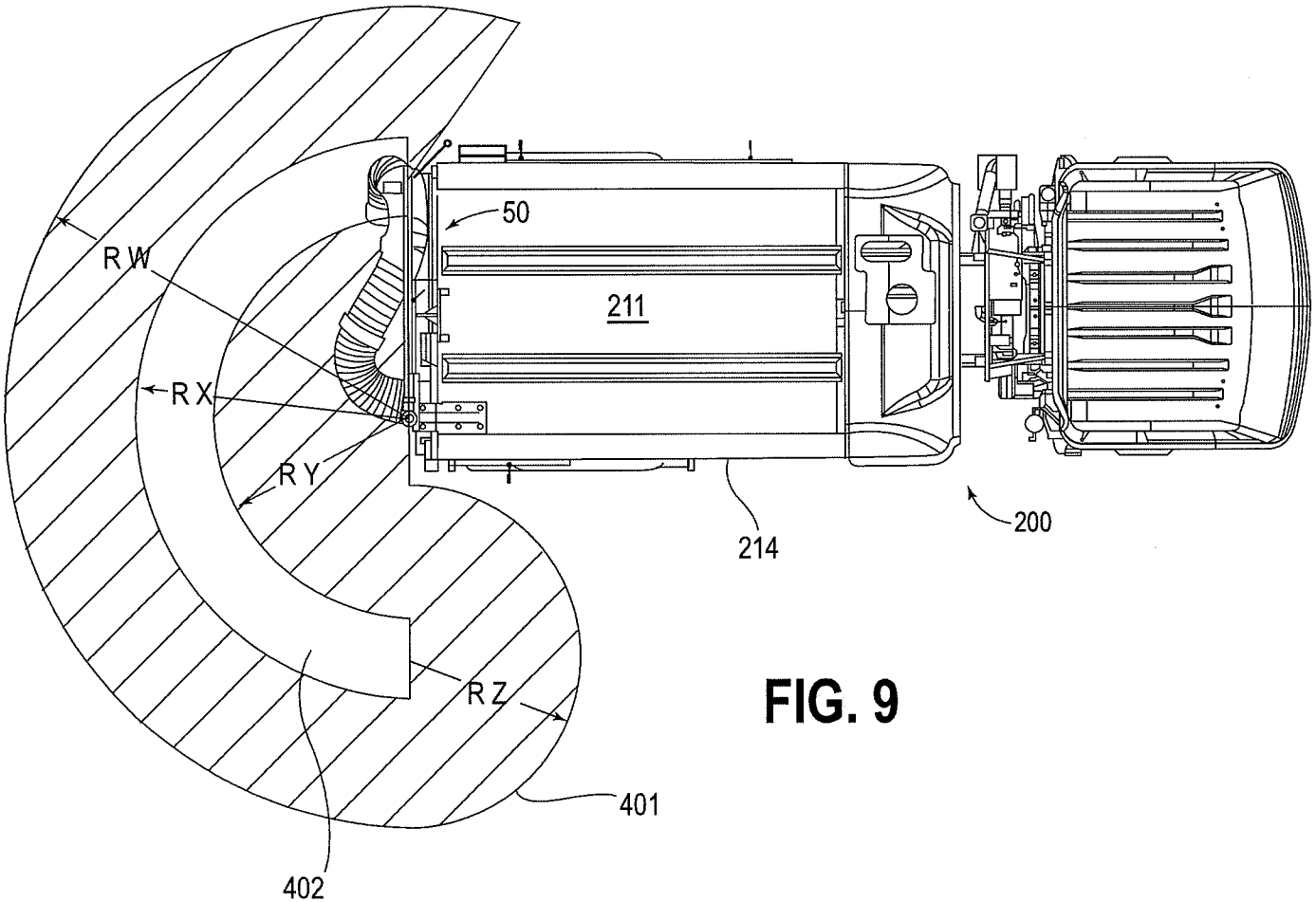
FIG. 9 is a top view of the articulating arm of FIG. 1 mounted to the debris hopper of FIG. 5.

As shown in FIG. 9, articulating vacuum hose 50 can operate throughout workable area 401. Workable area 401 is the area within which the open end 312 of vacuum hose 310 can be effectively extended to collect debris. Because articulating arm 100 has three degrees of freedom, articulating vacuum hose 50 can reach virtually any point within workable area 401. Also shown in FIG. 9 is workable area 402 which represents the workable area were articulating arm instead constructed as a fixed length, single arm system. For ease of reference, this type of system will be referred to as a 2D vacuum hose as the system has only two degrees of freedom that generally correspond to the first and second pivot axes of articulating arm 100. Also, it should be noted that workable areas 401 and 402 are diagrammatic and exemplary in nature and do not show the exact contours of any particular installation. However, in relative terms, it can be readily appreciated that workable area 401 is substantially greater than workable area 402 corresponding to a 2D vacuum hose system. This is so for several reasons, as explained below.

Figure 6:
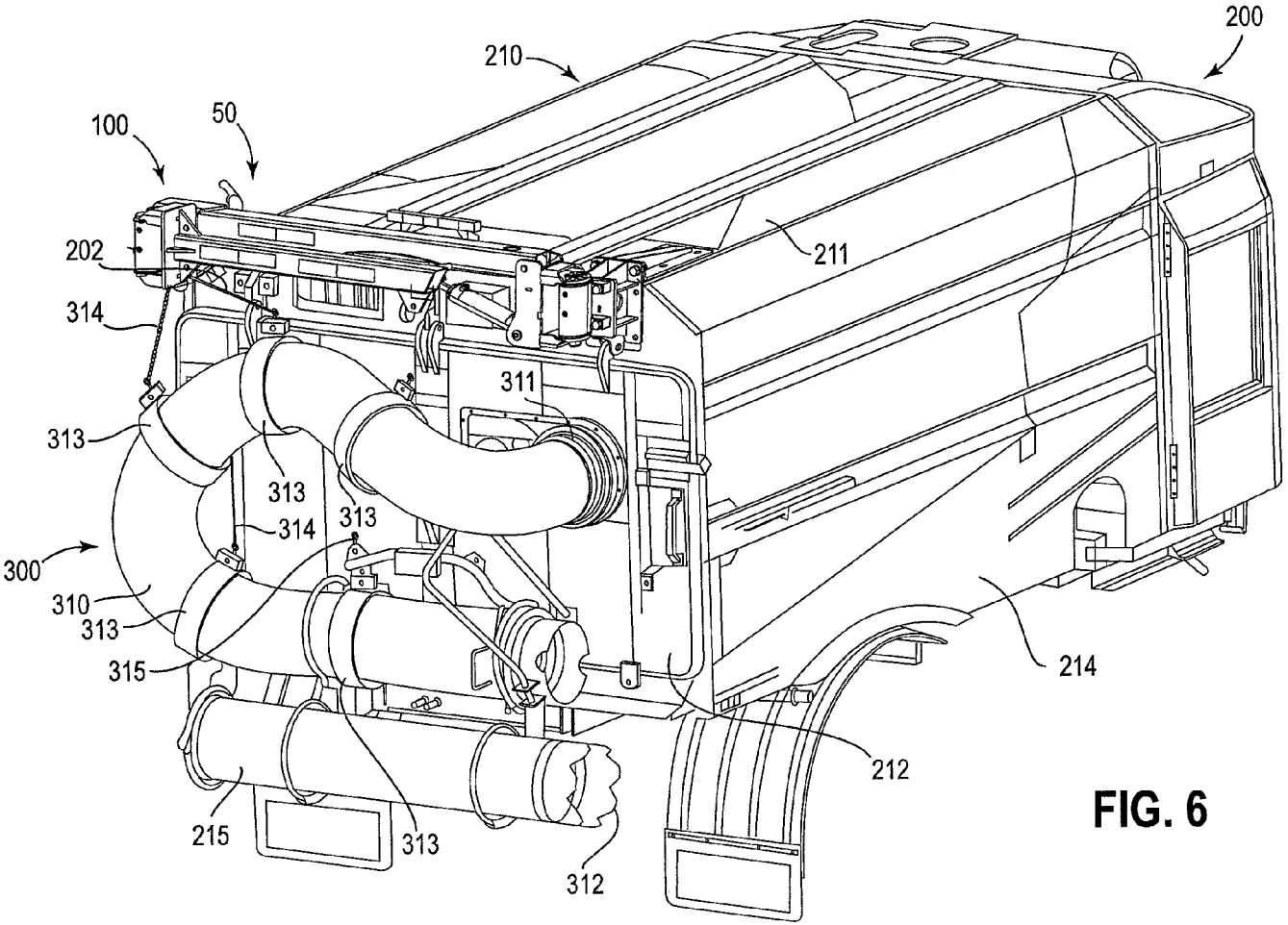
FIG. 6 is a rear perspective of the articulating arm of FIG. 1 mounted to the debris hopper of FIG. 5.
Figure 7:
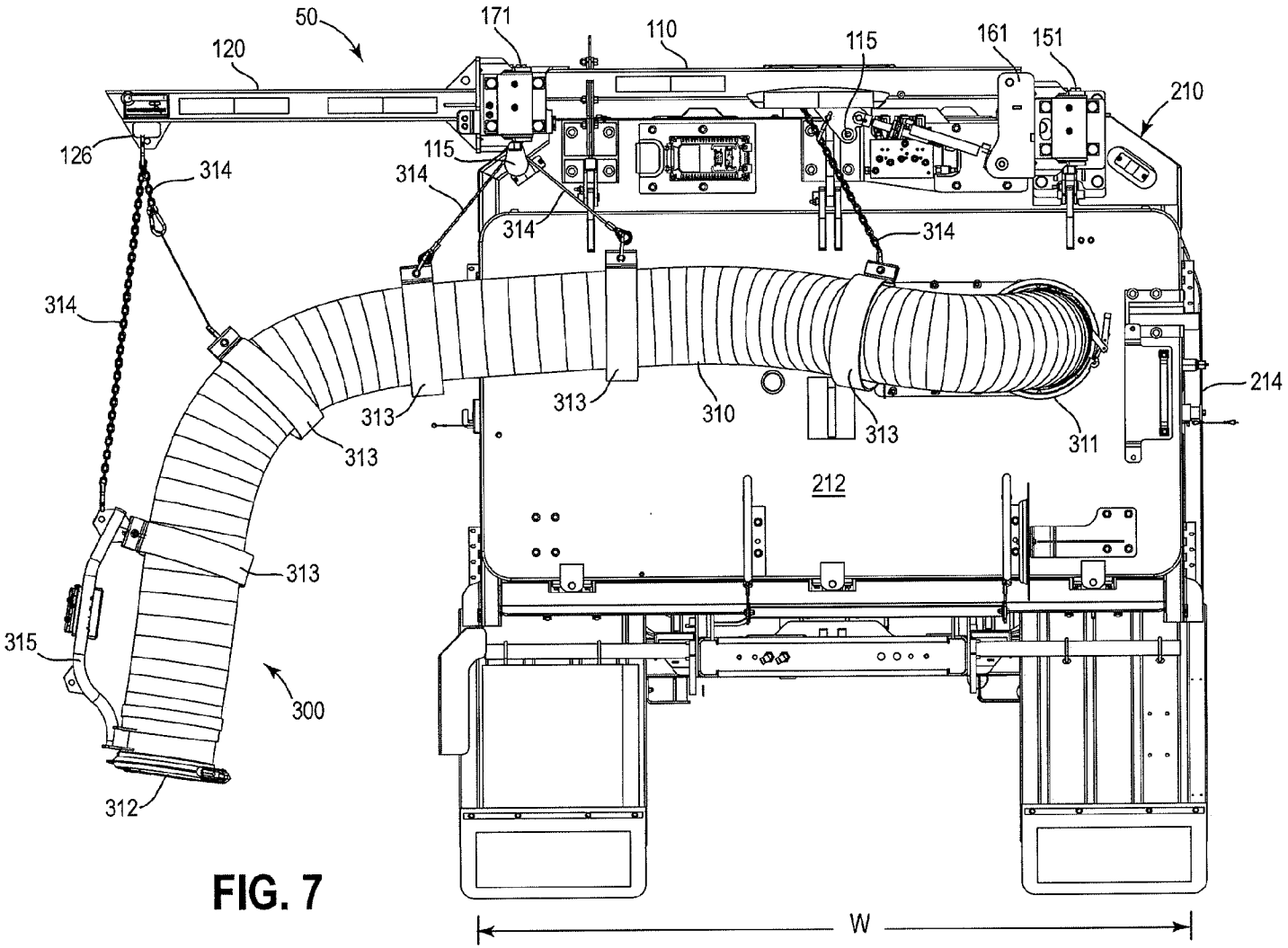
FIG. 7 is a rear view of the articulating arm of FIG. 1 mounted to the debris hopper of FIG. 5.
Figure 8:
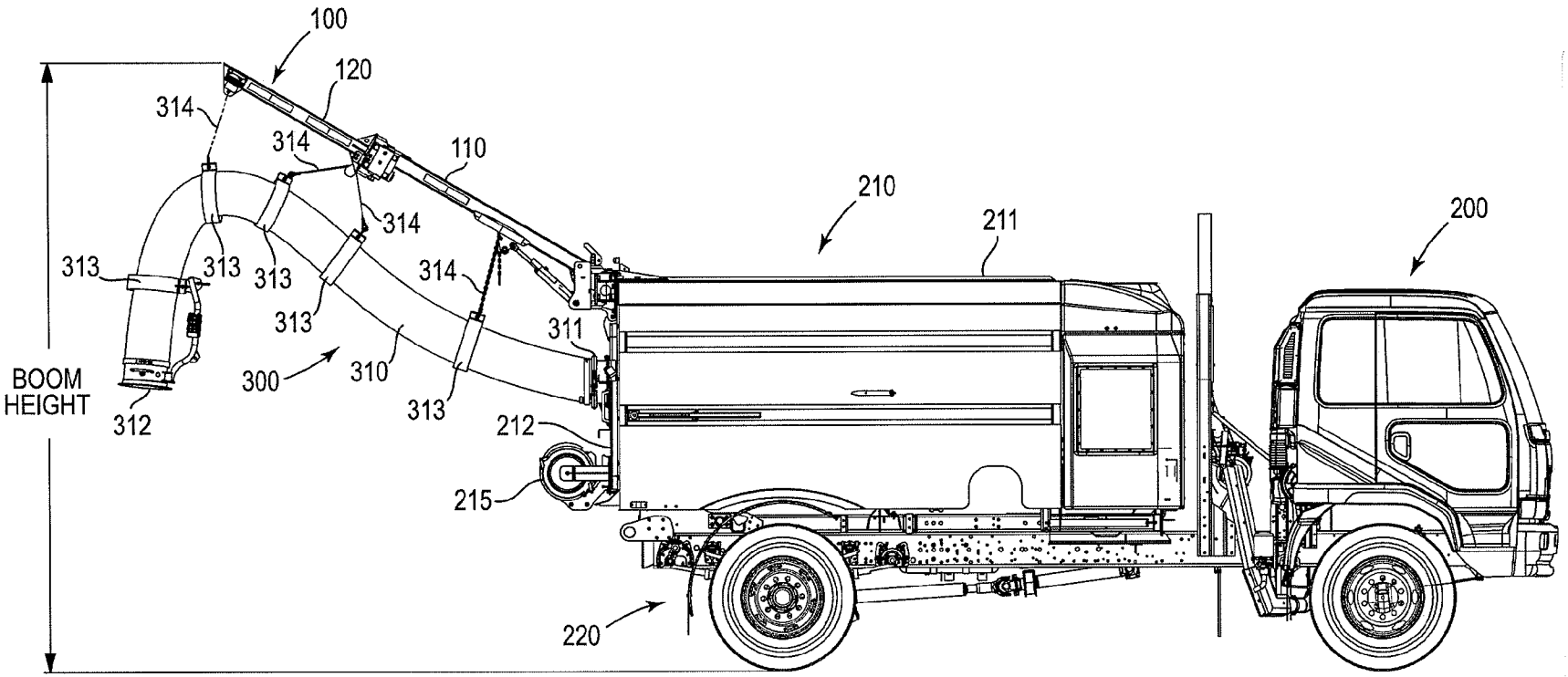
FIG. 8 is a side view of the articulating arm of FIG. 1 mounted to the debris hopper of FIG. 5.

One reason for the greater workable area is that the total effective length of articulating arm 100 can be greater than the rear profile of debris hopper 210, as defined by width "w" as shown on FIG. 7. As stated previously, this is so because first and second arm extensions 110, 120 can be folded flat to fit within the rear profile of debris hopper 210 to a storage position as shown in FIG. 6. In the storage position, articulating vacuum hose 50 can be secured to the rear 212 of debris hopper 210 during periods of non-use. However, when articulating arm 100 and vacuum hose assembly 300 are placed in the extended position, as shown in FIGS. 7-8, articulating vacuum hose 50 can extend well beyond the rear profile of the debris hopper 210. Further, as can be readily seen in FIG. 8, the overall height that can be attained by the second end 122 of second arm extension 120, and thus open end 312 of vacuum hose 310, is greater than what can be attained by a typical 2D system. As compared to a 2D vacuum hose, whose length is constrained by the width of the rear profile of the vehicle, the greater radius and height that can be achieved with articulating vacuum hose 50 equates to a significantly larger workable area. This radius can be up to twice as large when each of first and second arm extensions 110 and 120 have a length equal to the rear width "w" of debris hopper 210.

Another reason for the greater workable area is that third pivot axis 171 provides for an additional degree of freedom that does not exist with a fixed length, single arm system. Because third pivot axis 171 and first pivot axis 151 are parallel, articulating arm 50 can articulate about a wide range of angles. In combination with second pivot axis 161, this configuration allows the open end 312 of vacuum hose 310 to reach any point within workable area 401. Because of this configuration, workable area 401 extends along a first side 214 of debris hopper 210 which is also the side that mounting bracket 130 is mounted towards. Extension to this area is made possible by pivoting second arm extension 120 which can continue to rotate towards first side 214 about third pivot axis 171 even as first arm extension 110 has rotated to its fullest extent towards that side. Such an operation is simply not possible with a typical 2D vacuum hose.

Because first workable area 401 is significantly greater than that of second workable area 402, operator productivity is increased. Because of the limited workable area of a typical 2D vacuum hose application, an operator must often reposition the vehicle multiple times to reach debris with the vacuum hose. In some instances, an operator must also install one or more vacuum hose extensions 215 to reach certain debris locations that are simply beyond the reach of a single arm system. In contrast, many such areas are reachable by articulating vacuum hose 50 thereby reducing or even eliminating the need for vehicle repositioning. Also, because of the greater effective length of articulating vacuum hose 50, vacuum hose 310 can be longer as compared to 2D vacuum hoses. In the example embodiment shown, vacuum hose 310 is approximately 3.5 feet longer.

Yet another advantage of the articulating vacuum hose 50 is a greater ability to position the open end 312 of vacuum hose 310 over a specific location. In certain applications, such as catch basin cleaning, such positioning is required so that the vacuum hose can extend vertically through a catch basin, manhole or other access way. To accomplish this, extension tubes must generally be attached to open end 312 of vacuum hose 310 and then lowered through the access way to reach the point of debris collection. Because articulating arm 100 can move through a variety of angles to reach virtually any point within workable area 401, the required positioning of open end 312 is easily accomplished. However, in 2D vacuum hose applications the vehicle itself must be precisely maneuvered to a position that is along the radius of the supporting arm. As one can appreciate, such a process is generally inefficient because such maneuvering requires additional personnel to spot the supporting arm's position or, if only a single operator is present, frequent repositioning of the vehicle to reach the desired location. In addition, a greater overall height can be achieved by the disclosed system as compared to prior art single arm systems. This greater overall height also allows for more precise positioning and for the use of longer extension tubes.

In operation, the position of articulating vacuum hose 50 can be maneuvered through the use of an electro-mechanical operator interface (not shown) which controls first, second and third pivot mechanisms 150, 160 and 170. Additionally, sensors and programming can be incorporated for a "smart boom" automatic type of operation. Also, a vacuum control switch (not shown) can be located near open end 312 to enable an operator to easily activate and deactivate the vacuum source located within debris hopper 210. Vacuum control switch (not shown) opens a gate valve (not shown) at the first end 311 of vacuum hose 310 which is normally in a closed position and prevents vacuum communication between debris hopper 220 and vacuum hose 310. It should also be noted that first and third pivot mechanisms 150 and 170 could be constructed of non-powered hinges rather than hydraulic actuators and that actuator 163 could be constructed as a gas spring. A gas spring would counterbalance the weight of the assembly such that the operator could manipulate articulating vacuum hose 50 with little effort. Additionally, non-powered pivot mechanisms would also allow for articulating vacuum hose 50 to be manually positioned. With this type of configuration, articulating arm 100 will automatically articulate about axes 151, 161 and 171 to follow hose assembly 300 as open end 312 is maneuvered by the operator via handle 315.

When articulating vacuum hose 50 is not in use, articulating vacuum hose 50 can be placed in a storage position wherein second arm extension 120 is in the folded position and wherein first arm extension 110 is rotated about first pivot axis 151 such that it is generally parallel and adjacent to the rear surface 212 of debris hopper 210. By use of the term "parallel" it is meant to include angles up to at least plus or minus two degrees from parallel between first arm extension 110 and the rear surface 212 of debris hopper 210. In this position, the second side 114 of first arm extension 110 is facing the rear surface 212 of debris hopper 210. When articulating arm 100 is in the storage position, hose assembly 300 is generally held against the rear surface of debris hopper 210 and open end 312 of vacuum hose 310 can be covered with a cap (not shown). Vehicle 200 may also have other elements designed for retaining hose assembly 300 against the rear surface 212. As related previously, articulating arm 100 is shown in the storage position in FIG. 6.

Also, articulating vacuum hose 50 and debris hopper 210 can configured such that debris hopper 210 cannot be moved to a dumping position unless articulating vacuum hose 50 is in the storage position. This is accomplished through the use of an arm position sensor (not shown) that is engaged only when articulating vacuum hose 50 is in the storage position. When articulating vacuum hose 50 is not in the storage position, the sensor is disengaged and the debris hopper 210 is electrically locked out from moving to the dumping position. Additionally, first, second and third pivot mechanisms 150, 160 and 170 can be configured to be disabled in applications where a vehicle primary collection system 230 is present and in use.

A method for collecting debris is also disclosed. In such a method the articulating vacuum hose 50 is mounted to a vehicle 200 and moved from the previously described storage position to a debris collection location. More specifically, the open end 312 of vacuum hose 310 is moved to the debris collection location. Subsequently, the vacuum source is activated and the debris is collected. The articulating vacuum hose 50 is then returned to the storage position. The method may also include collecting debris that is located at a distance away from the vehicle 200 that is greater than the width of the debris hopper 210.

What is claimed is:

1. A collection system for removing debris, the system comprising:

(a) a vehicle having a first generally vertical rear exterior surface having a first width and a vacuum source;

(b) an articulating arm comprising:

(i) a first arm extension having a first side, the first arm extension being pivotally connected at a first end to the vehicle, the first arm extension being rotatable about a generally vertical first pivot axis to a first position that is generally parallel to the vehicle rear surface such that the first arm extension extends across at least a portion of the first width of the vehicle rear surface;

(ii) a second arm extension having a first side, the second arm extension being pivotally connected to a second end of the first arm extension, the second arm extension being rotatable about a second pivot axis that is offset from the first arm extension such that the first and second arm extensions are movable to a folded position to provide generally parallel first and second arm extensions with the first sides of the arm extensions facing each other, wherein the second pivot axis is generally vertical when the first arm extension is placed in the first position; and (c) a vacuum hose connected to the vacuum source and supported by the articulating arm.

2. The collection system of claim 1, wherein the first arm extension is rotatable about a third pivot axis that is perpendicular to the first axis.

3. The collection system of claim 2, wherein the articulating arm further comprises:

(a) a first pivot mechanism having an actuator configured to rotate the first arm extension about the first pivot axis;

(b) a second pivot mechanism having an actuator configured to rotate the second arm extension about the second pivot axis; and (a) a third pivot mechanism having an actuator configured to rotate the first arm extension about the third pivot axis.

4. The collection system of claim 3, wherein the position of the articulating arm and vacuum hose are positionable from a storage position to a collection position:

(a) in the storage position, the vacuum hose is adjacent to a rear vehicle surface, the first arm extension is placed in the first position and the second arm extension is generally flat against the first arm extension;

(b) in the collection position, the vacuum hose and articulating arm are positioned such that an open end of the vacuum hose can effectively collect the debris.

5. The collection system of claim 4, wherein power to the vacuum source and to the pivot mechanisms can be controlled by a user interface located on the vacuum hose.

6. The collection system of claim 5, wherein power to the vacuum source and the position of the articulating arm can be controlled from within the vehicle.

7. The collection system of claim 1 wherein the vacuum hose is supported by at least the first arm extension.

8. The collection system of claim 1 wherein the vacuum hose is supported by at least the second arm extension.

9. An articulating vacuum hose for a debris collection vehicle, the articulating vacuum hose comprising:

(a) an articulating arm, the articulating arm comprising:

(i) a mounting bracket for securing the articulating arm to the vehicle;

(ii) a first arm extension having a first end, a second end and a first side;

(iii) a second arm extension having a first end, a second end and a first side;

(ii) a first pivoting mechanism pivotably connecting the mounting bracket to the first end of the first arm extension, the first pivoting mechanism including an actuator for rotating the first arm extension relative to the mounting bracket about a first pivot axis;

(iii) a second pivoting mechanism pivotably connecting the second end of the first arm extension to the first end of the second arm extension, the second pivoting mechanism including an actuator for rotating the second arm extension with respect to the first arm extension about a second pivot axis;

(iv) a third pivoting mechanism pivotably connecting the mounting bracket to the first end of the first arm extension, the third pivoting mechanism including an actuator for rotating the first arm extension relative to the mounting bracket about a third pivot axis, wherein the third pivot axis is generally perpendicular to the first pivot axis; and (b) a vacuum hose having a first end and a second end, the first end being configured to be connected to a vacuum source, the second end being open for the removal of debris, the vacuum hose being supported by the articulating arm;

(c) wherein the first and second pivot axes are parallel to and offset from each other such that the arm extensions can be moved to a folded position wherein the arm extensions are generally parallel and the first sides of the arm extensions generally face each other;

(d) the mounting bracket being configured to be mounted to a horizontal surface and a vertical surface of the vehicle such that the first arm extension extends across at least part of a width of the vertical vehicle surface when the articulating arm is placed in the folded position, wherein the first and second pivot axes are generally vertical in the folded position.

10. The articulating vacuum hose of claim 9 wherein the vacuum hose is supported by at least the first arm extension.

11. The articulating vacuum hose of claim 9 wherein the vacuum hose is supported by at least the second arm extension.

12. A collection system for removing debris, the system comprising:

(a) a vehicle having a first generally vertical rear exterior surface having a first width;

(b) a tubular segment; and (c) an articulating arm supporting the tubular segment, the articulating arm comprising:

(i) a first arm extension having a first side, the first arm extension being pivotally connected at a first end to the vehicle, the first arm extension being rotatable about a generally vertical first pivot axis to a first position that is generally parallel to the vehicle rear surface such that the first arm extension extends across at least a portion of the first width of the vehicle rear surface;

(ii) a second arm extension having a first side, the second arm extension being pivotally connected to a second end of the first arm extension, the second arm extension being rotatable about a second pivot axis that is offset from the first arm extension such that the first and second arm extensions are movable to a folded position to provide generally parallel first and second arm extensions with the first sides of the arm extensions facing each other, wherein the second pivot axis is generally vertical when the first arm extension is placed in the first position.

13. The collection system of claim 12 wherein the tubular segment is supported by at least the first arm extension.

14. The collection system of claim 12 wherein the tubular segment is supported by at least the second arm extension.

* * * * *